US008591315B2

(12) United States Patent
Gagner et al.

(10) Patent No.: US 8,591,315 B2
(45) Date of Patent: Nov. 26, 2013

(54) ENVIRONMENTAL EFFECTS FOR NEAR WIN EVENTS

(75) Inventors: Mark B. Gagner, West Chicago, IL (US); Timothy T. Gronkowski, Chicago, IL (US); Damon E. Gura, Chicago, IL (US); Alfred Thomas, Las Vegas, NV (US)

(73) Assignee: WMS Gaming, Inc., Waukegan, IL (US)

( * ) Notice: Subject to any disclaimer, the term of this patent is extended or adjusted under 35 U.S.C. 154(b) by 154 days.

(21) Appl. No.: 13/264,407

(22) PCT Filed: Apr. 14, 2010

(86) PCT No.: PCT/US2010/031015

§ 371 (c)(1),
(2), (4) Date: Oct. 14, 2011

(87) PCT Pub. No.: WO2010/120867

PCT Pub. Date: Oct. 21, 2010

(65) Prior Publication Data

US 2012/0028720 A1 Feb. 2, 2012

Related U.S. Application Data

(60) Provisional application No. 61/169,357, filed on Apr. 15, 2009.

(51) Int. Cl.
*G07F 17/32* (2006.01)

(52) U.S. Cl.
USPC ..... 463/20; 463/16; 463/25; 463/29; 463/31

(58) Field of Classification Search
USPC ..... 463/16, 20, 25, 31
See application file for complete search history.

(56) References Cited

U.S. PATENT DOCUMENTS

| | | | | |
|---|---|---|---|---|
| 7,364,508 | B2 | 4/2008 | Loose et al. | |
| 2006/0009285 | A1 * | 1/2006 | Pryzby et al. | 463/30 |
| 2007/0293304 | A1 | 12/2007 | Loose et al. | |
| 2008/0220840 | A1 | 9/2008 | Katz et al. | |

FOREIGN PATENT DOCUMENTS

| | | |
|---|---|---|
| WO | WO2008045453 | 4/2008 |
| WO | WO2008051796 | 5/2008 |
| WO | WO2010120867 | 10/2010 |

OTHER PUBLICATIONS

"PCT Application No. PCT/US10/31015 International Preliminary Report on Patentability", Jul. 7, 2011 , 12 pages.
"PCT Application No. PCT/US10/31015 International Search Report", Jun. 28, 2010 , 11 pages.

* cited by examiner

*Primary Examiner* — Omkar Deodhar
(74) *Attorney, Agent, or Firm* — DeLizio Gilliam, PLLC

(57) ABSTRACT

An establishment can coordinate devices (e.g., lights, speakers, displays) to enhance a game playing environment based on events detected in a network of wagering game machines. A system can be implemented that determines an environmental effect based on an event of a wagering game (e.g., a near win event), regardless of the particular wagering game developer/manufacturer. The system can determine the environmental effect to be created for an event at the wagering game machine, at a server, etc. A request for the environmental effect is then supplied to the process and/or machine that causes the devices to create the environmental effect.

18 Claims, 10 Drawing Sheets

ENVIRONMENTAL EFFECTS FOR NEAR WIN EVENTS

RELATED APPLICATIONS

This application claims the priority benefit of U.S. Provisional Application Ser. No. 61/169,357 filed Apr. 15, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to wagering game systems, and more particularly to wagering game systems including systems that create environmental effects.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

Some wagering games/machines provide entertainment by enhancing a near win experience. A wagering game machine enhances a near win experience with some audio and/or video from the wagering game machine to suggest to a player that the player came close to winning. The wagering game machine may play a particular melody that crescendos, but stops prematurely. This additional stimulation can make near wins entertaining for a player.

SUMMARY

In some embodiments, a method comprises determining that a wagering game event occurs at a wagering game machine. Wagering game event data that represent the wagering game event are processed. The method determines that the wagering game event is a near win event and determines a location associated with the near win event based on the processing of the wagering game event data. The method selects a set of one or more environmental effect operations which, when performed, generate environmental stimuli directed at a physical area that comprises the location. The method selects the set of one or more environmental effect operations based, at least in part, on the wagering game event being the near win event and the location associated with the near win event. The method causes the set of one or more environmental effect operations to be performed.

In some embodiments, said causing the set of one or more environmental effect operations to be performed comprises one of transmitting the set of one or more environmental effect operations to a set of one or more environmental effect generating devices to perform corresponding ones of the set of one or more environmental effect operations, remotely invoking the set of one or more environmental effect operations on the set of one or more environmental effect generating devices, and executing the set of one or more environmental effect operations.

In some embodiments, the set of one or more environmental effect generating devices comprises one or more of a light controlling device, an audio controlling device, a receiver, a display, a vibrating chair, a scent emitter, a motion generator, and an air generating device.

In some embodiments, said determining that the wagering game event occurs at the wagering game machine comprises receiving the wagering game data from a wagering game process running on the wagering game machine or a portal process running on the wagering game machine.

In some embodiments, said determining that the wagering game event is the near win event comprises one of determining if the wagering game data indicate an event identifier that represents a near win and determining if the wagering game data indicate outcome data beyond a particular threshold that corresponds to a near win.

In some embodiments, one or more machine-readable media encoded with a set of instructions, which when executed by a set of one or more processors, causes the set of one or more processors to perform operations that comprises determining if event data generated by a wagering game instance represent a near win event; determining an environmental effect for the near win event; constructing a request message for the environmental effect for the near win event, wherein the request message indicates a physical location of the wagering game instance and the environmental effect; and supplying the constructed request message to a server to request the server to produce the environmental effect directed at the physical location.

In some embodiments, the operations further comprise retrieving the event data from a logical socket in a wagering game machine.

In some embodiments, said operation of determining the environmental effect for the near win event comprises at least one of evaluating a history of wagering game events for the wagering game instance, evaluating a history of wagering game events for a player, evaluating player preferences, and determining current state of at least a physical area proximate to a location of the wagering game instance.

In some embodiments, said operation of determining the environmental effect for the near win event comprises determining if one or more other players are involved with the wagering game instance in addition to a first player associated with the wagering game instance.

In some embodiments, one or more machine-readable media encoded with a set of instructions, which when executed by a set of one or more processors, causes the set of one or more processors to perform operations that comprises determining that a wagering game event occurs at a wagering game machine; processing wagering game event data that represent the wagering game event; determining that the wagering game event is a near win event and determining a location associated with the near win event based on the processing of the wagering game event data; selecting a set of one or more environmental effect operations which, when performed, generate environmental stimuli directed at a physical area that comprises the location; selecting the set of one or more environmental effect operations based, at least in part, on the wagering game event being the near win event and the location associated with the near win event; causing the set of one or more environmental effect operations to be performed.

In some embodiments, the operations further comprise determining one or more modifications to apply to the set of one or more environmental effect operations.

In some embodiments, the operation of determining one or more modifications to apply to the set of one or more environmental effect operations comprises one or more of determining a current state of the floor area and determining a community associated with a player associated with the wagering game event.

In some embodiments, said operation of determining the current state of the floor area comprises determining at least one of population density in the physical area, noise level in the physical area, ongoing environmental effects being produced in the physical area, wagering game machine density, floor configuration, and pending events that affect population density in the physical area.

In some embodiments, said operation of determining the community associated with the player associated with the wagering game event comprises determining a number of Internet views of the instance of the wagering game, a number of players with registered interest in the player associated with the wagering game event, a number of other players of the instance of the wagering game, and attributes of members of the community viewing the instance of the wagering game.

In some embodiments, the operations further comprise analyzing player account data to determine that the player account data satisfies one or more criteria for the set of one or more environmental effect operations in response to said determining that the wagering game event occurred at the wagering game machine. The player account data is associated with the wagering game machine.

In some embodiments, the operations further comprise updating environmental effect creation state data that indicates the environmental stimuli directed at the physical area. The player is associated with the player account data.

In some embodiments, an apparatus comprises a network interface, a store, an environmental effects selector unit, a floor variable monitor, an environmental effects modifier, and an environment effects initiator. The network interface is operable to receive wagering game event data that represents a wagering game event. The store is operable to host a plurality of environmental effect operations that indicate operations that can be performed by one or more devices to produce environmental effects. The environmental effects selector unit is coupled with the store. The environmental effects selector unit is operable to select one or more environmental effect operations from the store based, at least in part, on wagering game event data received by the network interface. The floor variable monitor is operable to maintain ongoing environmental effect operations data and to maintain floor state data that indicates current environmental state of an area associated with a wagering game machine, and operable to generate a floor variable based, at least in part, on the floor state data and the ongoing environmental effect operations data. The environmental effects modifier is coupled with the floor variable monitor. The environmental effects modifier is operable to compute one or more environmental effect modifier parameters based, at least in part, on one or more floor variables input from the floor variable monitor. The environmental effects initiator is coupled with the network interface, the environmental effects modifier, and the environmental effects selector. The environmental effects initiator is operable to dynamically apply one or more environmental effects modifier parameters computed by the environmental effects modifier to a set of one or more environmental effects operations selected by the environmental effects selector to generate a modified set of one or more environmental effects operations. The environmental effects initiator is also operable to communicate the modified set of one or more environmental effect operations to a set of one or more environmental effect generating devices via the network interface.

In some embodiments, the apparatus further comprises an event notifier communicatively coupled with the floor variable monitor and the environmental effects selector unit, the event notifier operable to detect occurrence of an event at a wagering game machine, determine if the event is a relevant event, and to notify the floor variable monitor and the environmental effects selector unit of the relevant event.

In some embodiments, the apparatus further comprises a community variable monitor communicatively coupled with the event notifier and the environmental effects modifier, the community variable monitor operable to collect data about at least one of an online community and a tournament community in response to notification of an event from the event notifier.

In some embodiments, an apparatus comprises means for determining that a wagering game event is a near win event and an area proximate to a wagering game machine associated with the wagering game event; means for selecting a set of one or more environmental effects operations to be performed to create one or more environmental effects in the area proximate to the wagering game machine for the near in event; and a network interface. The network interface is operable to communicate the set of one or more environmental effects operations.

In some embodiments, the apparatus further comprises means for dynamically modifying the set of one or more environmental effects operations in accordance with one or more of community data and data about at least the area proximate to the wagering game machine.

In some embodiments, the apparatus further comprises means for collecting the one or more of the community data and the data about at least the area proximate to the wagering game machine.

In some embodiments, the data about at least the area proximate to the wagering game machine comprises one or more of population density in the area, noise level in the area, ongoing environmental effects being produced in the area, wagering game machine density in the area, floor configuration in the area, and pending events that affect population density in the area.

In some embodiments, the apparatus further comprises means for controlling a set of one or more environmental effect generating devices to perform the set of one or more environmental effect operations.

In some embodiments, the apparatus further comprises means for determining whether data of a player account associated with the wagering game machine satisfies one or more criteria for the set of one or more environmental effects.

BRIEF DESCRIPTION OF THE FIGURES

Example embodiments of the invention are illustrated in the Figures of the accompanying drawings in which.

DESCRIPTION OF THE EMBODIMENTS

The description that follows includes exemplary systems, methods, techniques, instruction sequences and computer program products that embody techniques of the present inventive subject matter. However, it is understood that the described embodiments may be practiced without these specific details. For instance, although examples refer to wagering games, embodiments can be implemented to create environmental effects for applications that complement wagering games. In other instances, well-known instruction instances, protocols, structures and techniques have not been shown in detail in order not to obfuscate the description.

An establishment can coordinate devices (e.g., lights, speakers, displays) to enhance a game playing environment based on events detected in a network of wagering game machines. A system can be implemented that determines an environmental effect based on an event of a wagering game (e.g., a near win event), regardless of the particular wagering game developer/manufacturer. The system can determine the environmental effect to be created for an event at the wagering game machine, at a server, etc. A request for the environmental effect is then supplied to the process and/or machine that causes the devices to create the environmental effect.

Figure 1:
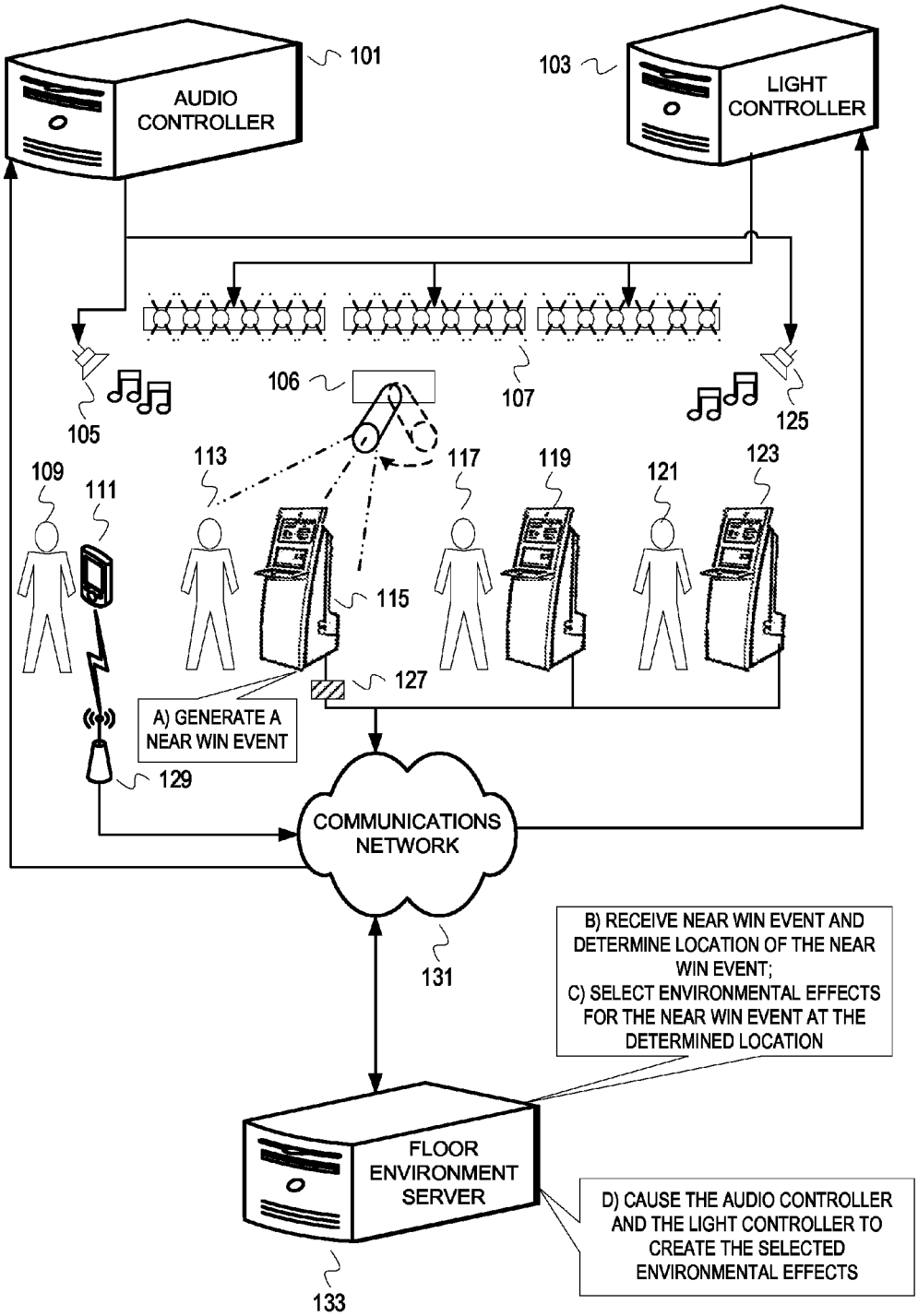
FIG. 1 depicts a conceptual diagram of an example system creating an environmental effect based on a near win event.

FIG. 1 depicts a conceptual diagram of an example system creating an environmental effect based on a near win event. In the depicted system, a floor environment server 133 is in communication, via a communications network 131, with an audio controller 101 and a light controller 103. The light controller 103 controls multiple panels of lights 107 and a spotlight 106. The audio controller 101 controls speakers 105 and 125. The floor environment server 133 is also in communication with wagering game machines 115, 119, 123, and a portable wagering game machine 111. The floor environment server 133 communicates with the portable wagering game machine 111 wirelessly though an access point 129, which is networked with the communications network 131.

At a stage A, a near win event is generated at the wagering game machine 115. A player 113 hits four out of five cherries, for example. The wagering game machine 115 transmits data 127 (e.g., a message) indicating the near win event to the floor environment server 133 via the communications network 131.

At a stage B, the floor environment server 133 receives the data 127 that indicates the near win event, and determines location of the source of the data 127. A system can utilize various techniques for determining physical location of the source of the data 127. The floor environment server 133 may use a wagering game machine identifier indicated in the data 127 and determine physical location of the wagering game machine 115 with a grid of a casino floor. The floor environment server 133 may look up floor coordinates based on a wagering game machine identifier indicated in the data 127.

At a stage C, the floor environment server 133 selects environmental effects to be created based, at least in part, on the near win event indicated by the data 127. The floor environment server 133 can also select environmental effects to be created based on the determined location of the wagering game machine 115. For example, different areas of a casino floor may have different environmental effects creation devices available and/or nearby.

At stage D, the floor environment server 133 causes the selected environmental effects to be created. The floor environment server 133 supplies information and/or commands to the audio controller 101 and the light controller 103 that allows the controllers 101 and 103 to create the selected environmental effects, and that allows the controllers 101 and 103 to direct the created environmental effects at the wagering game machine 115. The light controller 103 causes the light panels 107 to start flashing. The light controller 103 also orients the spotlight 106 to focus on the wagering game machine 115 and the player 113 standing near the wagering game machine 115. The audio controller 101 causes the speakers 105 and 125 to begin playing celebratory music directed at the area occupied by the player 113 and the wagering game machine 115. These environmental effects can draw the attention and excite proximate players 109, 117, and 121, as well as the player 113. Since the player 113 has not actually won, the environmental effects will be created accordingly. For example, the lights and the music can respectively increase in scintillating frequency and in volume, but then abruptly terminate to reflect the event as a near win and not a win.

Figure 2:
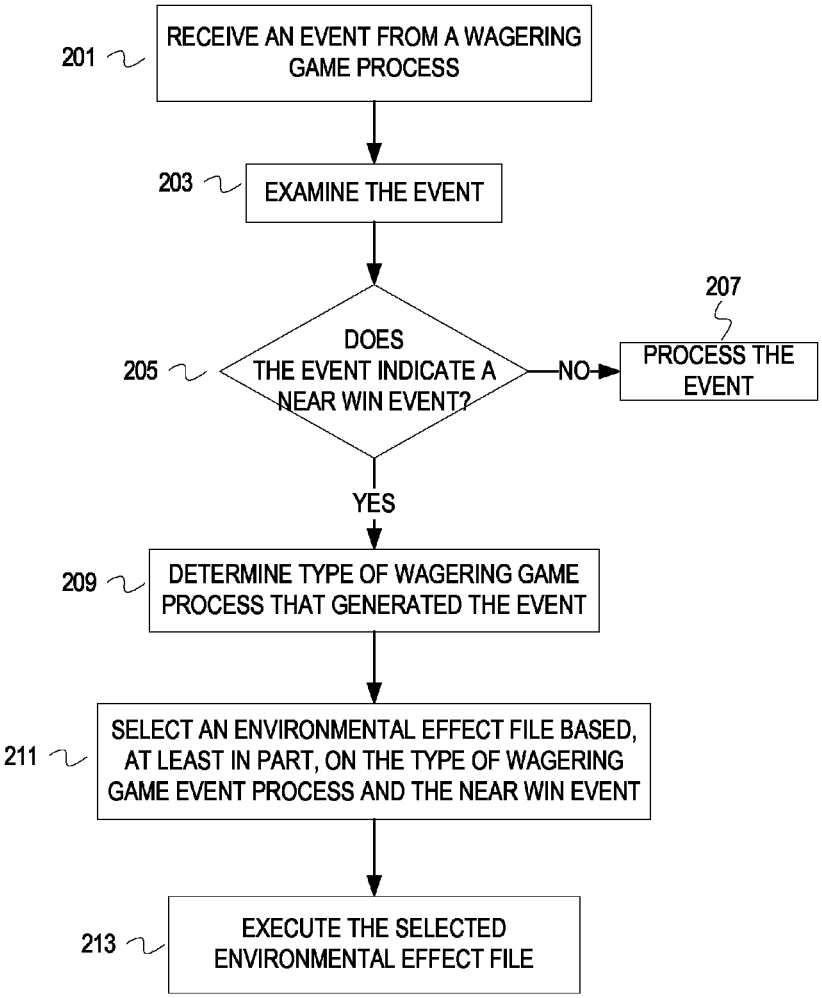
FIG. 2 depicts a flowchart of example operations for creating an environmental effect based on an event detected in a network of wagering game machines.

FIG. 2 depicts a flowchart of example operations for creating an environmental effect based on an event detected in a network of wagering game machines. At block 201, an event is received from a wagering game machine. For example, a message is received over a network, and the message indicates an event identifier (e.g., an event code or name).

At block 203, the event is examined. For instance, the message is decapsulated and examined to determine that the message at least communicates occurrence of an event. The message can then be indexed into or parsed to determine the indication of the event. And the indication of the event can be processed to determine information about the event.

At block 205, it is determined if the indicated event indicates a near win event. If the event indicates a near win event, then control flows to block 209. Otherwise, control flows to block 207.

At block 207, the event is processed. For example, a log or statistics are updated.

If the event was a near win event, then a type of wagering game process that generated the event is determined at block 209. For instance, a system examining the data determines whether the event was generated by a base game or a bonus game process.

At block 211, an environmental effect file is selected based, at least in part, on the type of wagering game event process and the near win event. For example, different categories of environmental effects may be associated with different types of wagering game processes. To illustrate, a first area based category of environmental effects that affect a larger area and utilize more environmental effect devices can be associated with bonus game processes. A second area based category of environmental effects directed to a more confined area proximate to the source of the event is associated with base game processes. In addition, near win events can be associated with a environmental effects that seemingly terminate premature or run for a shorter period of time than environmental effects associated with win event. Embodiment can also define a modifying parameter that modified an environmental effect when selected. For example, a modifying parameter can be selected for near win events and applied to an environmental effect to only create half of the environmental effect (e.g., half of the devices, half of the duration, etc.).

At block 213, the selected environmental effect file is executed.

As stated above, a system can be implemented that creates an environmental effect for an event that occurs in a network of wagering game machines independent of developers/manufacturers. A program or application can be installed that handles events from a base game and processes events to determine at least some operations in the selection of an environmental effect to be created.

Figure 3:
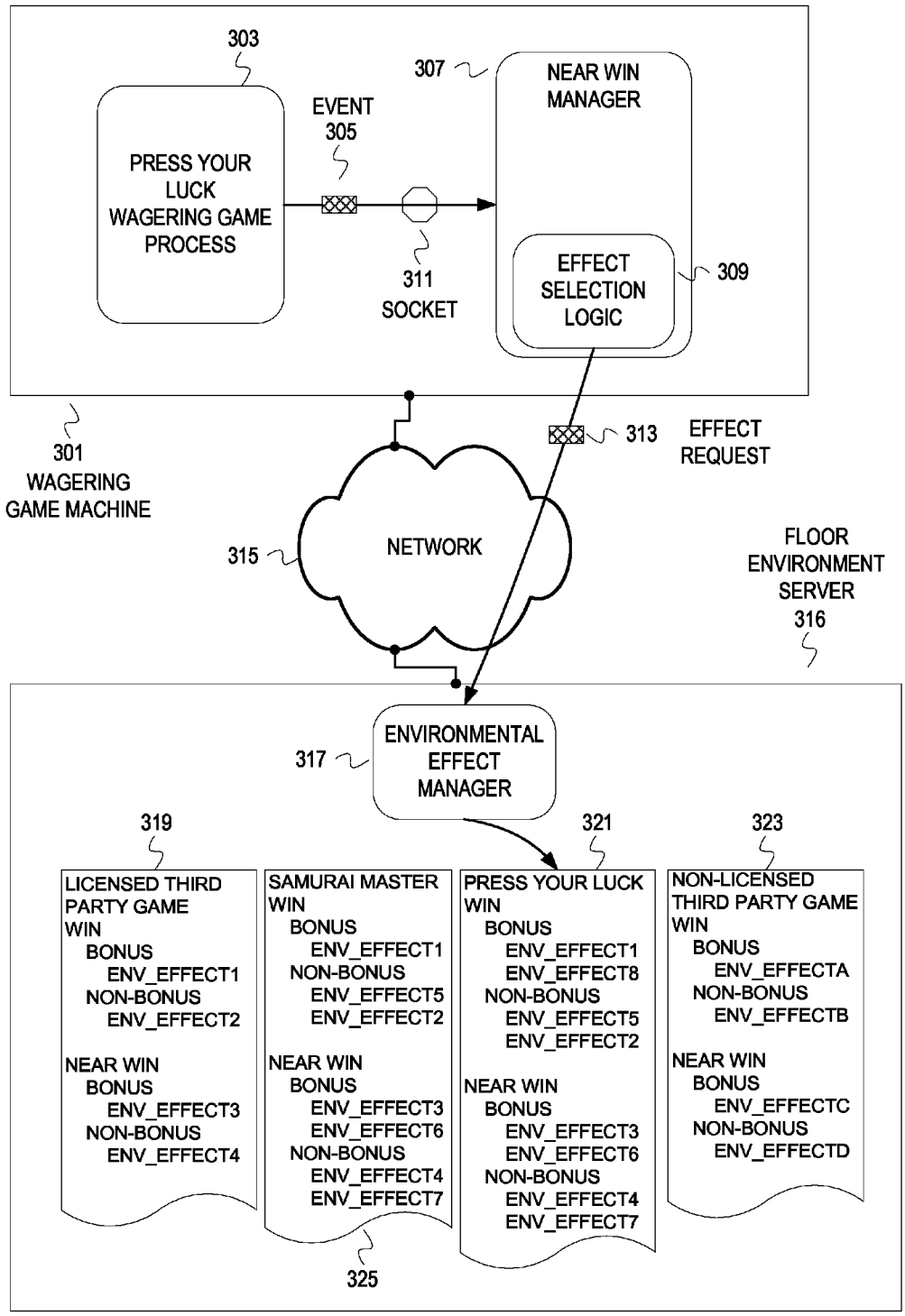
FIG. 3 depicts a conceptual diagram of an example portal configuration for handling events from a wagering game process.

FIG. 3 depicts a conceptual diagram of an example portal configuration for handling events from a wagering game process. A wagering game machine 301 communicates with a floor environment server 316 via a network 315. The wagering game machine 301 hosts a wagering game process 303 for a wagering game "Press Your Luck" and a near win manager 307. The near win manager 307 comprises effect selection logic 309.

The near win manager 307 processes events from the wagering game process 303 and generates effect requests accordingly. In FIG. 3, the wagering game process 303 generates an event 305 to a socket 311. The near win manager 307 listens for data on the socket 311. When the wagering game process 303 generates the event 305 to the socket 311, the near win manager reads or retrieves the event 305 from the socket 311. The effect selection logic 309 determines one or more environmental effects or a class of environmental effects based on the event 305. For example, the event 305 may indicate information that identifies the wagering game process 303 (i.e., a process for "Process Your Luck") and an event type (e.g., near win event). The effect selection logic 309 generates an effect request 313 based on this indicated information. For example, the effect selection logic 309 indicates in the effect request 313 that a non-bonus environmental effect for "Press Your Luck" should be created at a location of the wagering game machine 301. The degree of information indicated can vary. For instance, the effect selection logic 309 can request a particular environmental effect or can request a generic environmental effect (e.g., some audio). Every event generated by the wagering game process 303 does not necessarily result in selection of an environmental effect. For instance, 3 out of 5 may be result in an environmental effect when a casino is not crowded and ignored when the casino is crowded. In addition, environmental effects are not limited to near win events. For example, certain win events can be processed and environmental effects selected. Further, the near win manager 307 and/or effect selection logic 309 can be configured to filter events based on various criteria (e.g., times, floor conditions, wagering history, player data, etc.).

The floor environment server 316 processes the effect request 313 generated by the effect selection logic 309. After the wagering game machine 301 transmits the effect request 313 to the floor environment server 316, an environmental effect manager 317 of the floor environment server 316 fetches an appropriate environmental effect (e.g., loads a file, packages script, etc.). In FIG. 3, the environmental effect manager 317 examines the effect request 313 and selects an environmental effect from a structure 321 that indicates effects indicated for "Press Your Luck." The floor environment server 316 hosts other environmental effect structures 319, 325, and 323. The environment effects structure 325 indicates effects associated with a game "Samurai Master." The environmental effect structure 319 indicates effects associated with a licensed third party game (i.e., game that has been licensed to use the associated environmental effects). The environmental effect structure 323 indicates effects associated with a non-licensed third party game (i.e., game that has been not been licensed to use particular environmental effects, but has been associated with environmental effects nonetheless). A developer or promoter of the environmental effects system can associate specific environmental effects or enhanced environmental effects to those who acquire a license. The developer or promoter can associate a generic class of environmental effects to those who do not acquire a license, perhaps to satisfy a casino owner.

Each of the structures 319, 321, 323, and 325 indicate different organizations of environmental effects. Table 1 identifies the environmental effects indicates for the various events and various wagering games.

TABLE 1

Association of effects to events across different wagering games

| | Win | | Near Win | |
|---|---|---|---|---|
| | Bonus | Non-Bonus | Bonus | Non-Bonus |
| Licensed Third Party Game | ENV_EFFECT1 | ENV_EFFECT2 | ENV_EFFECT3 | ENV_EFFECT4 |
| Samurai Master | ENV_EFFECT1 | ENV_EFFECT2<br>ENV_EFFECT5 | ENV_EFFECT3<br>ENV_EFFECT6 | ENV_EFFECT4<br>ENV_EFFECT7 |
| Press Your Luck | ENV_EFFECT1<br>ENV_EFFECT8 | ENV_EFFECT2<br>ENV_EFFECT5 | ENV_EFFECT3<br>ENV_EFFECT6 | ENV_EFFECT4<br>ENV_EFFECT7 |
| Non-Licensed Third Party Game | ENV_EFFECTA | ENV_EFFECTB | ENV_EFFECTC | ENV_EFFECTD |

For this illustration, the environmental effect manager 317 determines that the structure 321 indicates environmental effects for "Press Your Luck," which is indicated in the effect request 313. The environmental effect manager 317 can then selects one of ENV_EFFECT4 and ENV_EFFECT7, assuming the effect request 313 indicates a non-bonus near win event. Various factors (e.g., time of day, current floor state, system load, etc.) can impact the selection made by the environmental effect manager 317. In addition, the effect request 313 can specify ENV_EFFECT7, thus removing the selection operation from the environmental effect manager 317, or at least providing a starting point. It should be understood that the illustrated example does not limit embodiments, and effects can be organized and accessed in accordance with any one of a variety of techniques (e.g., hash tables, search trees, etc.).

Although the example depicted in FIG. 3 associates particular environmental effects with events and wagering games, embodiments are not so limited. Embodiments can associate an environmental effect with other data and/or select an environmental effect based on factors other than a type of wagering game event or wagering game. A system can dynamically adapt to different players, different times, etc. Thus, an environmental effect may or may not be created based on information, such a snapshot of player history. Embodiments can also indicate a class or level of environmental effect to be created for an event, thus providing some flexibility and/or allowing dynamic editing/creating of environmental effects.

Figure 9:
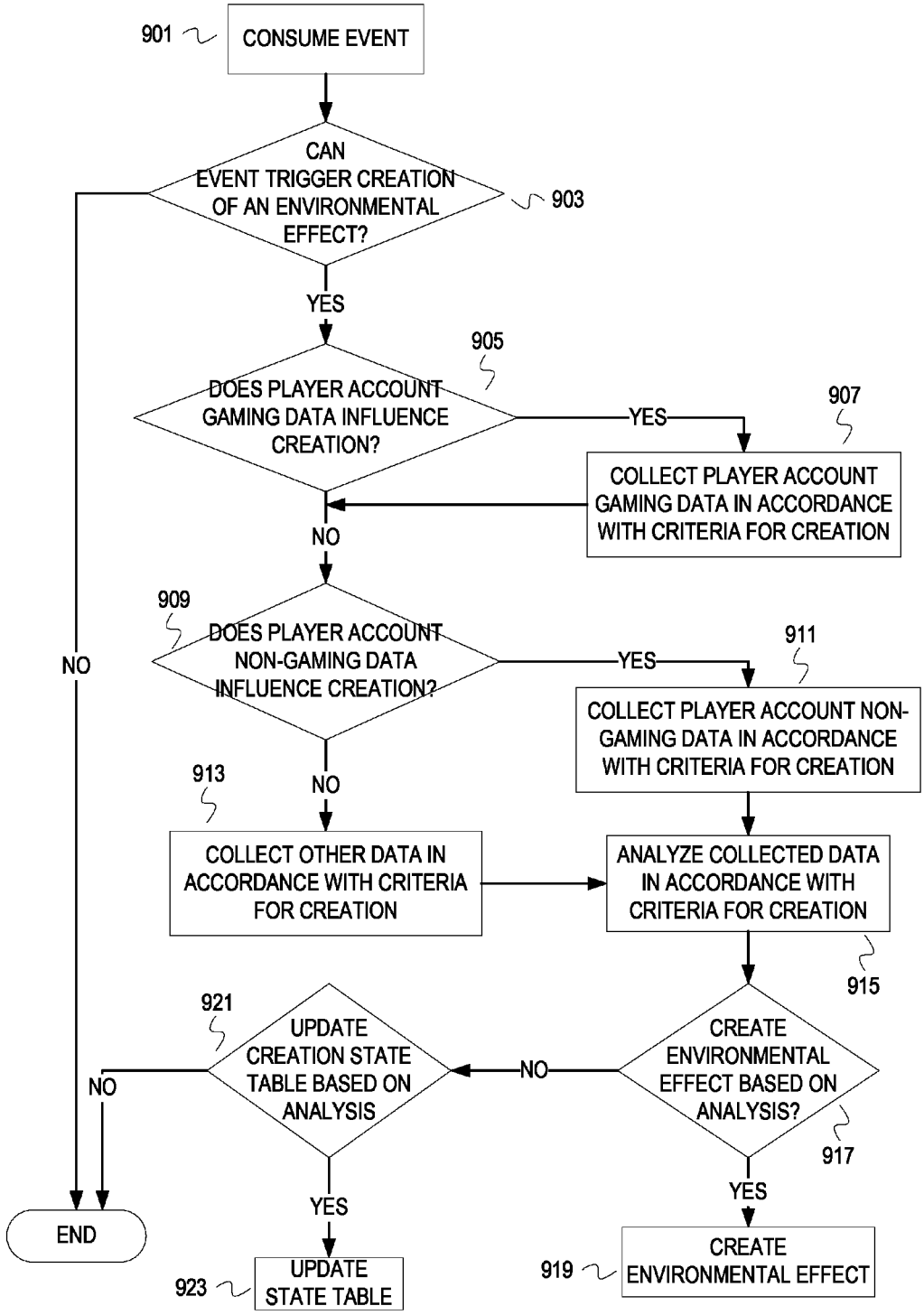
FIG. 9 depicts a flowchart of example operations for analyzing player account data for dynamic adaptive environmental effect creation.

FIG. 9 depicts a flowchart of example operations for analyzing player account data for dynamic adaptive environmental effect creation. At block 901, an event is consumed. The event can be a wagering game event (e.g., win event, near win event, coin in event, etc.), a non-wagering game event (e.g., hospitality services event, a supplemental application event, etc.), etc. Examples of consuming the event include one or more of decapsulating a message that conveys the event, parsing a data structure that represents the event, decrypting data to determine the event, etc.

At block 903, it is determined if the event can trigger creation of an environmental effect. A system can be configured to discriminate between different events for environmental effect creation. For instance, a system can be configured to create an environmental effect for drink orders but not for ticket orders. If the event cannot trigger environmental effect creation, then the flow ends. If the event can trigger environmental effect creation, then control flows to block 905.

At block 905, it is determined if player account gaming data influence environmental effect creation. Criteria can be defined for if and/or when an environmental effect is created. For example, rules and/or conditions can indicate that an environmental effect will be created for a near win event if the player has not won for the last 30 spins and/or if the player has been continually playing for 40 minutes without a win. As another example, rules and/or conditions can indicate that an environmental effect will be created if a player lost 20 consecutive spins, and hit a win that rewarded an amount beyond a threshold win amount. If the player account data influence the environmental effect creation, then control flows to block 907. If the player account data does not influence the environmental effect creation, then control flows to block 909.

At block 907, player account gaming data is collected in accordance with the criteria for environmental effect creation. For instance, gaming history data over the last 30 spins is collected from the player account if the criteria indicates a 30 spin threshold. Control flows from block 907 to block 909.

At block 909, it is determined if player account non-gaming data influence environmental effect creation. For instance, rules and/or conditions can indicate that an environmental effect will be created for a hospitality services event. For example, an environmental effect may be created if a player has played for more than an hour without winning beyond a threshold and has made beverage orders beyond a threshold amount. If player account non-gaming data influence environmental effect creation, then control flows to block 911. Otherwise, control flows to block 913.

At block 911, player account non-gaming data is collected in accordance with the criteria for environmental effect creation. For instance, beverage order history data over the last hour is collected from the player account if the criteria indicate a $50 order amount threshold within the preceding hour. Control flows from block 911 to block 915.

At block 913, other data is collected in accordance with the criteria. For instance, data about the wagering game machine or online viewers is collected. Control flows from block 913 to block 915.

At block 915, the collected data is analyzed in accordance with the criteria for environmental effect creation. For example, the collected data is compared against thresholds defined by the criteria.

At block 917, it is determined if the environmental effect is to be created based, at least in part, on the analysis. If the criteria are satisfied by the collected data, then control flows to block 919. If the criteria are not satisfied by the collected data, then control flows to block 921.

At block 919, the environmental effect is created.

At block 921, it is determined if an environmental effect creation state table should be updated based, at least in part, on the analysis. For instance, criteria may indicate that an environmental effect will be created if a player "coins in" (e.g., deposits via actual coins, tickets, electronic fund transfer, etc.) a certain amount over X wagers and loses a certain percentage of the amount over those X wagers. Although the player may not have wagered X times yet, a state table can be maintained to indicate a current amount wagered and the number of wagers since a beginning time. The state table can be used to reduce the number of accesses to the player account and/or in the case a player does not exist or cannot be accessed. If the environmental effect creation state table does not exist or should not be updated with the collected data, then flow ends. If the environmental effect creation state table should be updated, then control flows to block 923.

At block 923, the state table is updated.

Figure 4:
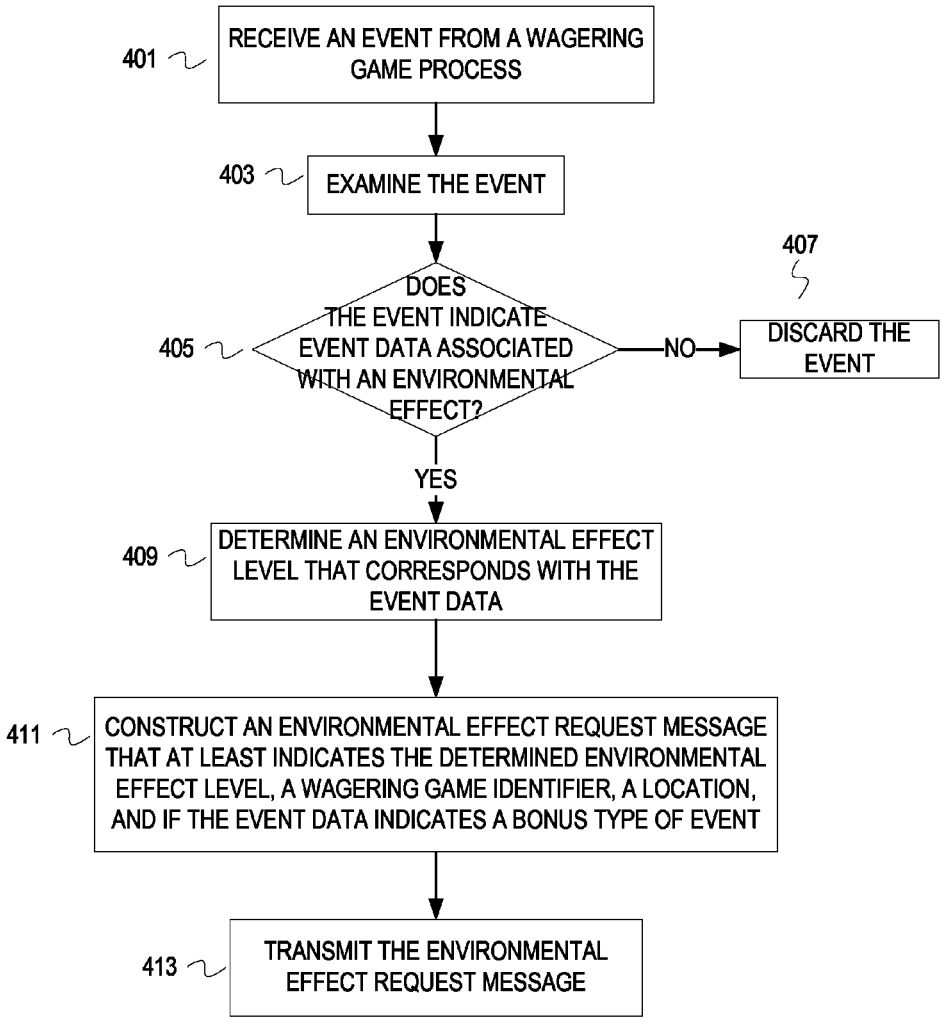
FIG. 4 depicts a flowchart of example operations for constructing an environmental effect request for a level of environmental effect.

FIG. 4 depicts a flowchart of example operations for constructing an environmental effect request for a level of environmental effect. At block 401, an event from a wagering game process is received. For example, a message transmitted from a portable wagering game machine is received.

At block 403, the event is examined. For example, a process decapsulates and parses the event.

At block 405, it is determined if the event indicates event data associated with an environmental effect. For instance, a data structure is accessed to determine if event data (e.g., a process identifier, a game name, an event code, etc.) read from the event is associated with an environmental effect in the data structure. As another example, a database is queried with the event data to determine if an environmental effect is associated with some or all of the event data. If the event indicates event data that has been associated with an environmental effect, then control flows to block 409. Otherwise, control flows to block 407.

At block 409, an environmental effect level that corresponds with the event data is determined. For example, bonus events can be associated with higher levels of environmental effects. A higher level of environmental effect can impact a larger area of a wagering game establishment, use select audio, allow requisition of large displays, etc. A lower level of environmental effect can be limited to a brief audio presentation.

At block 411, an environmental effect request message that at least indicates the determined environmental effect level, a wagering game identifier, and a location is constructed. The message may also be constructed to indicate if the event data indicates a bonus type of event.

At block 413, the constructed environmental effect is transmitted.

If control flowed from block 415 to block 409, then the event is discarded. Embodiments are not required to discard the event or prevented from performing other operations with the event, though. Embodiments can perform other operations to log information from the event, for example.

Figure 5:
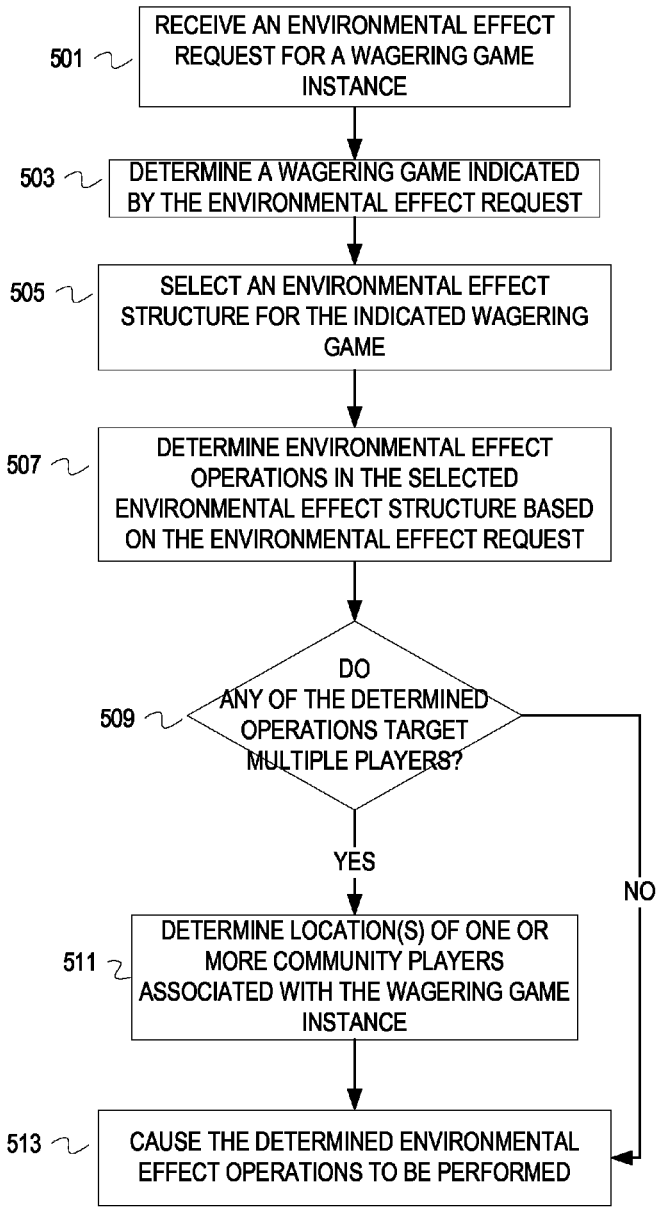
FIG. 5 depicts a flowchart of example operations for processing an environmental effect request message.

FIG. 5 depicts a flowchart of example operations for processing an environmental effect request message. At block 501, an environmental effect request for a wagering game instance is received.

At block 503, a wagering game indicated by the received request is determined. For example, the request encodes a wagering game identifier.

At block 505, an environmental effect structure is selected for the indicated wagering game. For instance, a database or search structure is accessed based on a wagering game identifier.

At block 507, environmental effect operations in the selected environmental effects structure are determined based on the environmental effect request. For instance, a script is accessed that indicates how to coordinate light panels and audio to create an environmental effect.

At block 509, it is determined if any of the determined operations target multiple players and/or patrons. For instance, an environmental effect may target nearby patrons/players and friends of the player at the machine that generated the event. As another example, an environmental effect may target members of a tournament. If the determined operations target multiple players/patrons, then control flows to block 511. If the determined operations do not target multiple players/patrons, then control flows to block 513.

At block 511, the location(s) of one or more players/patrons associated with the wagering game instance are determined. For instance, floor locations of machines where tournament members have logged on are determined.

At block 513, the determined environmental effect operations are caused to be performed. For instance, an environmental effects server directs light panels and audio presenting devices.

It should be understood that the depicted flowchart are examples meant to aid in understanding embodiments and should not be used to limit embodiments or limit scope of the claims. Embodiments may perform additional operations, fewer operations, operations in a different order, operations in parallel, and some operations differently. For instance, referring to FIG. 2, blocks 211 and 213 refer to a file. But embodiments are not limited to files. Operations can be performed that make API calls, execute commands, etc. With respect to FIG. 9, operations may not be performed to discriminate between different data because only one class of data will influence environmental effect creation. Additional operations can also be performed to filter other data.

As indicated in the above examples, various data can affect selection of environmental effects. In addition, the selection or the effects themselves can be adjusted or modified. For instance, a casino may want to adjust environmental effects in accordance with various crowd levels or based on a show schedule. In addition, an environmental effect and/or selection can be modified or adjusted based on input external to a wagering game establishment (e.g., members of an online community supported by the wagering game establishment and/or a wagering game developer).

Figure 6:
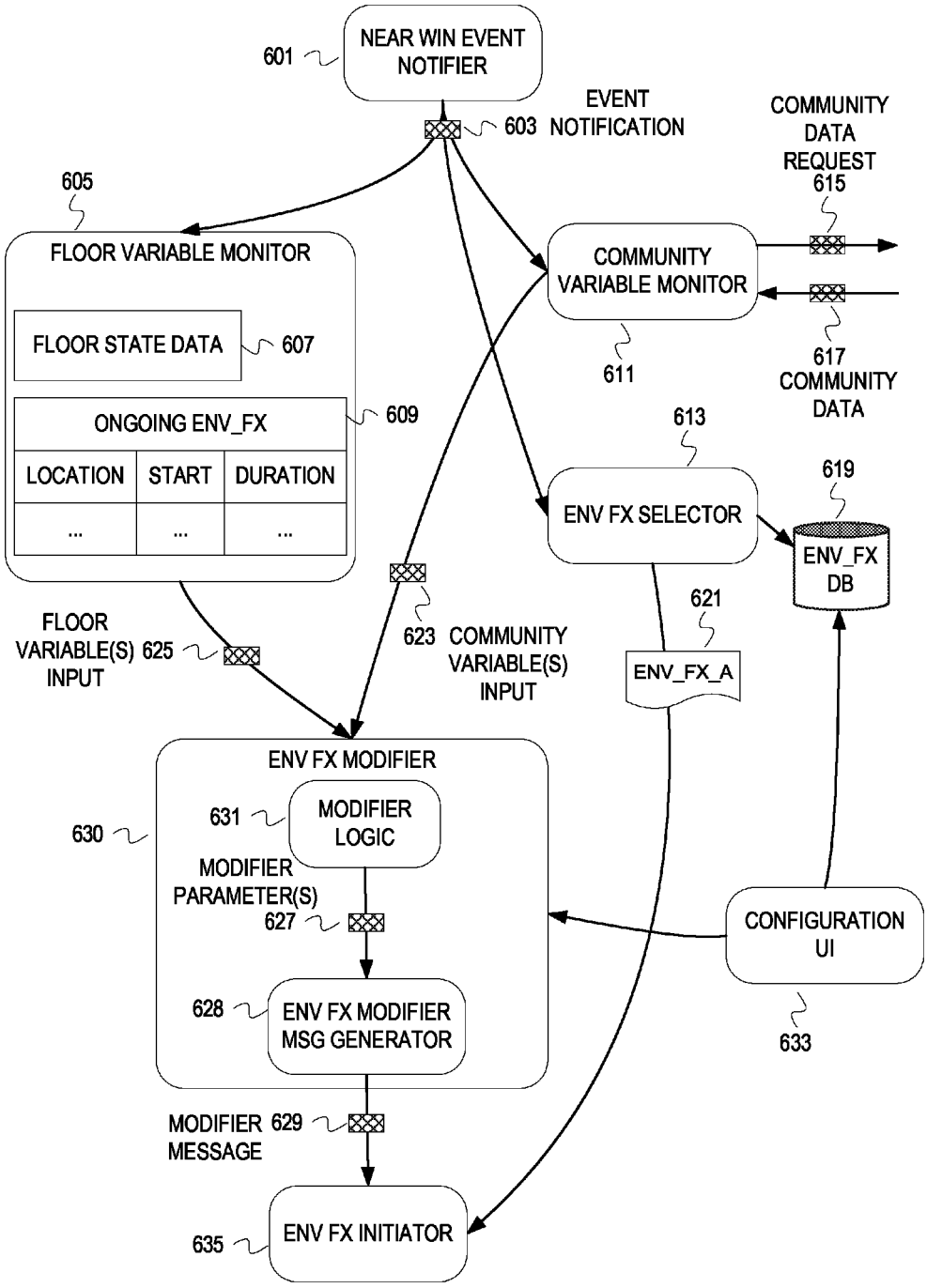
FIG. 6 depicts a conceptual diagram of an environmental effects manager.

FIG. 6 depicts a conceptual diagram of an environmental effects manager. The example environmental effects manager depicted in FIG. 6 comprises multiple components. The depicted environmental effects manager comprises a floor variable monitor 605 and a community variable monitor 611. The depicted environmental effects manager also comprises a near win event notifier 601, an environmental effects selector 613 ("ENV FX selector"), a configuration user interface 633, an environmental effects modifier 630 ("ENV FX modifier"), and an environmental effects initiator 635 ("ENV FX initiator"). Although not necessary, FIG. 6 also depicts the environmental effects manager as further comprising an environmental effects database 619 ("ENV_FX DB"). These components of the environmental effects manager operate to affect an environmental effects selection and/or modify a selected environmental effect.

The near win event modifier 601 detects occurrence of an event. For instance, a wagering game process may throw all events to a posting facility, such as a logical socket. The near win event notifier 601 examines these events to determine if they indicate a near win. For those events that indicate near win events, the near win event notifier 601 notifies the floor variable monitor 605, the community variable monitor 611, and the environmental effect selector 613. In FIG. 6, the near win notifier 601 generates an event notification 603. The event notification 603 comprises data about the event that allows floor variable monitor 605, the community variable monitor 611, and the environmental effects selector 613 to take action.

The floor variable monitor 605 generates floor variable data that can impact the selected environmental effect. FIG. 6 depicts the floor variable monitor 605 comprising floor state data 607 and an ongoing environmental effects data structure 609. In response to the event notification, the floor variable monitor 605 examines the floor state data 607 and the ongoing environmental effects data structure 609. The floor state data 607 indicates data about the state of a relevant area of a wagering game establishment (e.g., a particular slot machine bank, half of a casino floor, etc.). Examples of floor state data include population density, current volume, machine occupancy, etc. The ongoing environmental effects data structure 609 indicates data about previously initiated environmental effects that are still ongoing. In this example, the ongoing environmental effects data structure 609 indicates data about location, start time, and duration of each ongoing environmental effect. The floor variable monitor 605 can update the floor state data 607 and the ongoing environmental effects structure 609 in accordance with a variety of techniques (e.g., passively, periodically, in response to a trigger(s), etc.). Based on the data, the floor variable monitor 605 generates floor variable(s) input 625 to the environmental effects modifier 630. The floor variable(s) input 625 can be input that is taken into account (e.g., decibels, density value, number of ongoing environmental effects, etc.), can be a value to be applied to an environmental effect (e.g., fraction, percentage, negative or positive value, a diminishing flag, etc.).

The community variable monitor 611 generates community variable data that can impact the selected environmental effect. After being notified of a relevant event, the community variable monitor 611 generates a community data request 615. The community data request 615 requests community data from one or more servers that maintain a community for a player associated with the relevant event. The event notification 603 can indicate a player number, name, default guest identifier for an unregistered player, etc. In response, the community variable monitor 611 receives community data 617. Examples of the community data 617 include data that indicates online friends viewing the player, identifiers and/or locations of other tournament participants, casino friends that have registered an interest in the player, etc. The community variable monitor 611 then generates community variable(s) input 623 to the environmental effects modifier 630. The community variable input 623 can specify literal data (e.g., number of online friends viewing), representative data (e.g., an augmentation flag, multiplier, etc.), etc.

The environmental effects selector 613 uses the data from the event notification 603 to select one or more environmental effects from the environmental effects database 619. For instance, the environmental effects selector 613 determines that the event notification 603 indicates a particular near win event for a Samurai Master wagering game by WMS Gaming Inc. The environmental effects selector 613 will select the one or more environmental effects that have been associated with the particular near win event for the Samurai Master wagering game by WMS Gaming Inc. The one or more environmental effects can be associated with a near win event based on wagering game developer, particular wagering game title, etc. The environmental effects selector 613 selects ENV_FX_A, and communicates the selected environmental effect to the environmental effects initiator 635.

The environmental effects modifier 630 determines how to modify a selected environmental effect(s), and communicates the modification(s) to the environmental effects initiator 635. The environmental effects modifier 630, as depicted in FIG. 6, comprises modifier logic 631 and an environmental effects modifier message generator 628. The environmental effects modifier 630 receives the floor variable(s) input 625 from the floor variable monitor 605 and the community variable(s) input 623 from the community variable monitor 611. The modifier logic 631 generates a modifier parameter(s) 627 based on the floor variable(s) input 625 and the community variable(s) input 623. For instance, the modifier logic 631 can be configured to generate a modifier that increases volume of an audio effect or utilizes additional lighting display when the floor variable(s) input 625 indicates wagering activity below a given threshold. As another example, the modifier logic 631 can be configured to generate the modifier parameter(s) 627 to augment environmental effects most noticeable to a large number of online friends viewing the relevant player while diminishing environmental effects that would interfere with game play of other players in a densely populated floor area. The environmental effects modifier message generator 628 generates a modifier message 629 that indicates the modifier parameter(s) 627. The environmental effects modifier 630 passes the modifier message 629 to the environmental effects initiator 635.

The environmental effects initiator 635 initiates operations to create a selected environmental effect. In FIG. 6, the environmental effects initiator 635 receives the indication 621 of the selected environmental effect ENV_FX_A. The indication 621 can be a reference to a location of the operations for ENV_FX_A, can be the operations to be performed (e.g., machine code, a function call, etc.), etc. The environmental effects initiator 635 modifies the selected environmental effect ENV_FX_A in accordance with the modifier parameters(s) 627 conveyed by the modifier message 629. The environmental effects initiator 635 can insert the modifier parameter(s) into code that implements the operations for creating ENV_FX_A, possibly overwriting already existing parameters. Embodiments can also implement the environmental effects initiator 635 to generate values based on the conveyed modifier parameter(s) 627, and modify ENV_FX_A accordingly. After the environmental effects initiator 635 initiates operations to create an environmental effect, the environmental effects initiator 635 provides data to the floor variable monitor 605 to update the ongoing environmental effects structure 609.

In addition to the environmental effects modifier 630 dynamically adjusting an environmental effect, the environmental effects modifier 630 and the environmental effects database 619 can be modified. A configuration user interface 633 allows a user to edit code, settings, dependencies, and/or operations indicated for environmental effects in the environmental effects database 619. The configuration user interface 633 also allows a user to configure the modifier logic 631. The configuration user interface 633 can be used to change thresholds, tune generation of modifier parameters by the modifier logic, etc.

It should be understood that FIG. 6 depicts an example, and should not limit embodiments. For instance, a near win manager is not limited to being a near win manager and detecting near win events. An events manager can detect and react to a variety of events (e.g., coin in, log in, wins above a threshold, etc.). As another example variation, the near win event notifier 601 can generate an event notification message with data about an event for the environmental effects selector 613, and a different notification with less data for the monitors 605 and 611 trigger their operations. Embodiments can also be implemented with the monitors reacting to stimulus from the environmental effects selector 613 instead of the near win event notifier 601. Embodiments can also communicate a selected environmental effect to the environmental effects modifier 630, and allow the environmental effects modifier 630 to modify the selected environmental effect. Moreover, embodiments can implement the functionality of the various components differently (e.g., the environmental effects modifier 630 and the environmental effects initiator 635 can be implemented as a single module or component).

Figure 10:
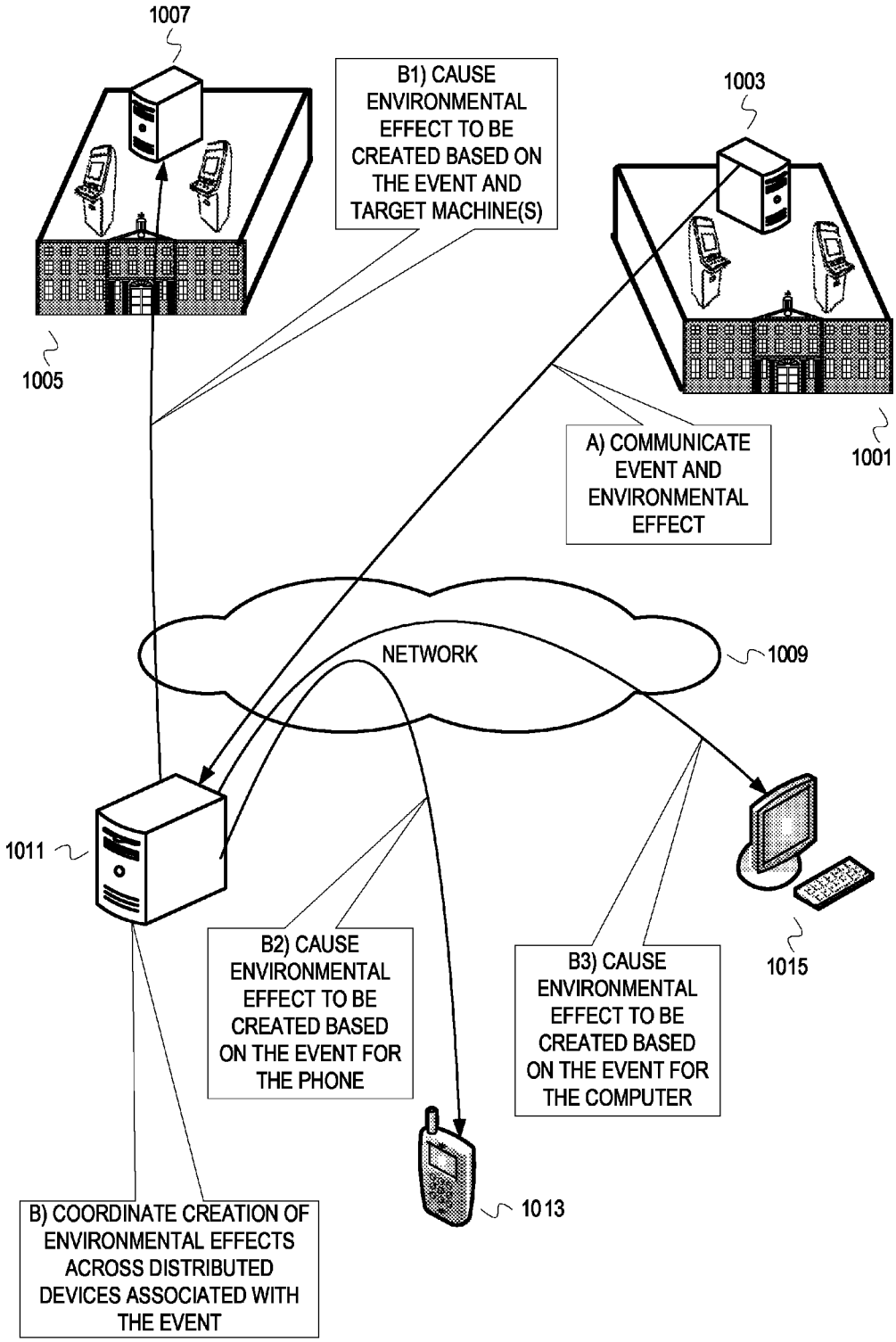
FIG. 10 depicts an example of environmental effects created beyond a single wagering game establishment.

The examples discussed to this point have been illustrated within the context of a wagering game establishment. Embodiments can, however, be distributed across different wagering game establishments, beyond the wagering game establishments, and involve devices other than wagering game machines. FIG. 10 depicts an example of environmental effects created beyond a single wagering game establishment. In FIG. 10, wagering game establishment 1005 and a wagering game establishment 1001 are communicatively coupled via network 1009 to a server 1011. The wagering game establishments 1005, 1001 respectively comprise floor environment servers 1007, 1003. The environmental effect server 1011 is also communicatively coupled with a computer 1015 (e.g., a personal computer in a business or residential location, a laptop wirelessly connected in a coffee shop, etc.) and a phone 1013. The users of the phone 1013, computer 1015 and wagering game machines in the wagering game establishments 1001 and 1005 may be playing in a tournament or a competitive game against each other, on teams, etc. The users of the phone 1013 and/or computer 1015 may also be monitoring (e.g., streaming video, animated tracking, etc.) players in at least one of the wagering game establishments 1001 and 1005.

The environmental effects server 1011 listens for events that trigger creation of an environmental effect at the distributed devices, and coordinates the creation. At a stage A, the floor environment server 1003 communicates an event (e.g., near win event, win event, bonus enrollment event, stage completion event, etc.) and an environmental effect to the environmental effects server 1011. The environmental effects server 1011 can relay the environmental effect to the distributed devices. The environmental effects server 1011 can select effects to be communicated to the distributed devices based on one or more of the target device(s), the locations, the jurisdictions, the event, and the environmental effect communicated by the floor environment server 1003, although embodiments do not necessarily communicate an environmental effect to the environmental effects server 1011.

At stage B, the environmental effects server 1011 coordinate creation of the environmental effects across the distributed devices associated with the event. The distributed devices (i.e., the phone 1013, the computer 1015, and corresponding wagering game machines in the wagering game establishments 1001, 1005) may be registered in advance of a community game (e.g., a tournament game, a competitive game, etc.) with the environmental effects server 1011. Embodiments may also communicate participant device identifiers (e.g., phone number, IP address, etc.) associated with an event or game to the environmental effects server 1011 from a central game controller. At stage B1, the environmental effects server 1011 causes an environmental effect to be created based on the communicated event and the target (e.g., target machine, target establishment, etc). At stage B2, the environmental effects server 1011 causes an environmental effect to be created for the phone 1013 based on the event. For instance, a video sequence and/or animated sequence can play on the phone with a particular tune appropriate for resources of a phone. At stage B3, the environmental effects server 1011 causes an environmental effect for the computer 1015 based on the event. Different environmental effects can be created for the phone 1013 and/or the computer 1015 based on status of the corresponding user (e.g., playing, watching, losing, winning, etc.). If the environmental effect has already been selected by the floor environment server 1003, then embodiments may delay creation of the selected environmental effect until the environmental effects server 1011 notifies the floor environment server 1003 to proceed with creating the selected environmental effect The environmental effect server 1011 can also communicate information to the distributed devices that alter selection of an environmental effect, modify a selected environmental effect, etc. For instance, local machines may not be aware of the total participants in a game. The total number of participants can impact the created environmental effect. To cause creation of an environmental effect, the environmental effect server 1011 can communicate an environmental effect identifier, operation for creating the environmental effect, a class of environmental effect, a reference to code or a command to create an environmental effect, etc.

Embodiments are not limited to the example depicted in FIG. 10. Various network architectures can be utilized to allow coordination of environmental effects across distributed devices. A central game controller can maintain a global view of distributed devices and communicate events to local environmental servers, or even directly control environmental effects creating devices. Embodiments may wait to create an environmental effect until instructed by a central environmental effect server. Embodiments may also establish communication between a central game controller and distributed and/or a central environmental effects server. For instance, a central game controller can generate an event that effects distributed participants. The central game controller communicates this event to a machine that consumes the event and causes an environmental effect to be created at the different physical locations that correspond to the distributed participants. The central game controller can communicate the event to a central environmental effects server (e.g., maintained by a wagering game developer or a third party) or to distributed local environmental effects servers.

Wagering Game Machine Architectures

Figure 7:
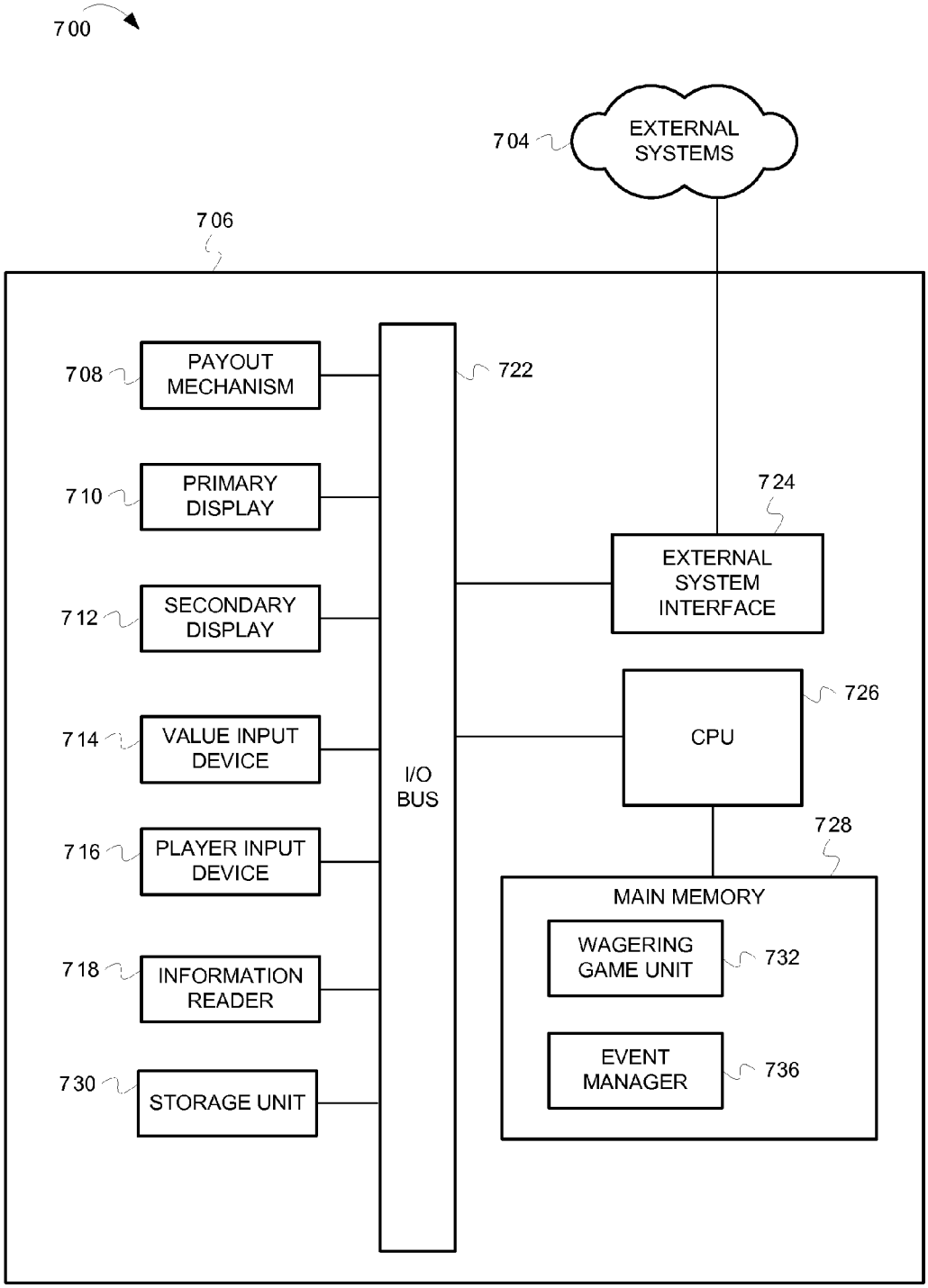
FIG. 7 is a block diagram illustrating a wagering game machine architecture, according to example embodiments of the invention.

FIG. 7 is a block diagram illustrating a wagering game machine architecture, according to example embodiments of the invention. As shown in FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In one embodiment, the wagering game unit 732 can present wagering games, such as video poker, video black jack, video slots, video lottery, etc., in whole or part. The main memory 736 also comprises an event manager 736. The event manager 736 performs operations that determines one or more environmental effects to be created based, at least in part, on events generated by the game unit 732. The event manager 736 can be implemented with functionality similar to functionality of the near win manager 307 of FIG. 3.

The CPU 726 is also connected to an input/output (I/O) bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks).

In one embodiment, the wagering game machine 706 can include additional peripheral devices and/or more than one of each component shown in FIG. 7. For example, in one embodiment, the wagering game machine 706 can include multiple external system interfaces 724 and/or multiple CPUs 726. In one embodiment, any of the components can be integrated or subdivided.

Any component of the architecture 700 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). Examples of machine-readable storage media include read only memory (ROM), random access memory (RAM), magnetic disk storage media, optical storage media, flash memory machines, etc. Examples of machine-readable transmission media include a media suitable for transmitting software over a network.

While FIG. 7 describes an example wagering game machine architecture, this section continues with a discussion wagering game networks.

Wagering Game Networks

Figure 8:
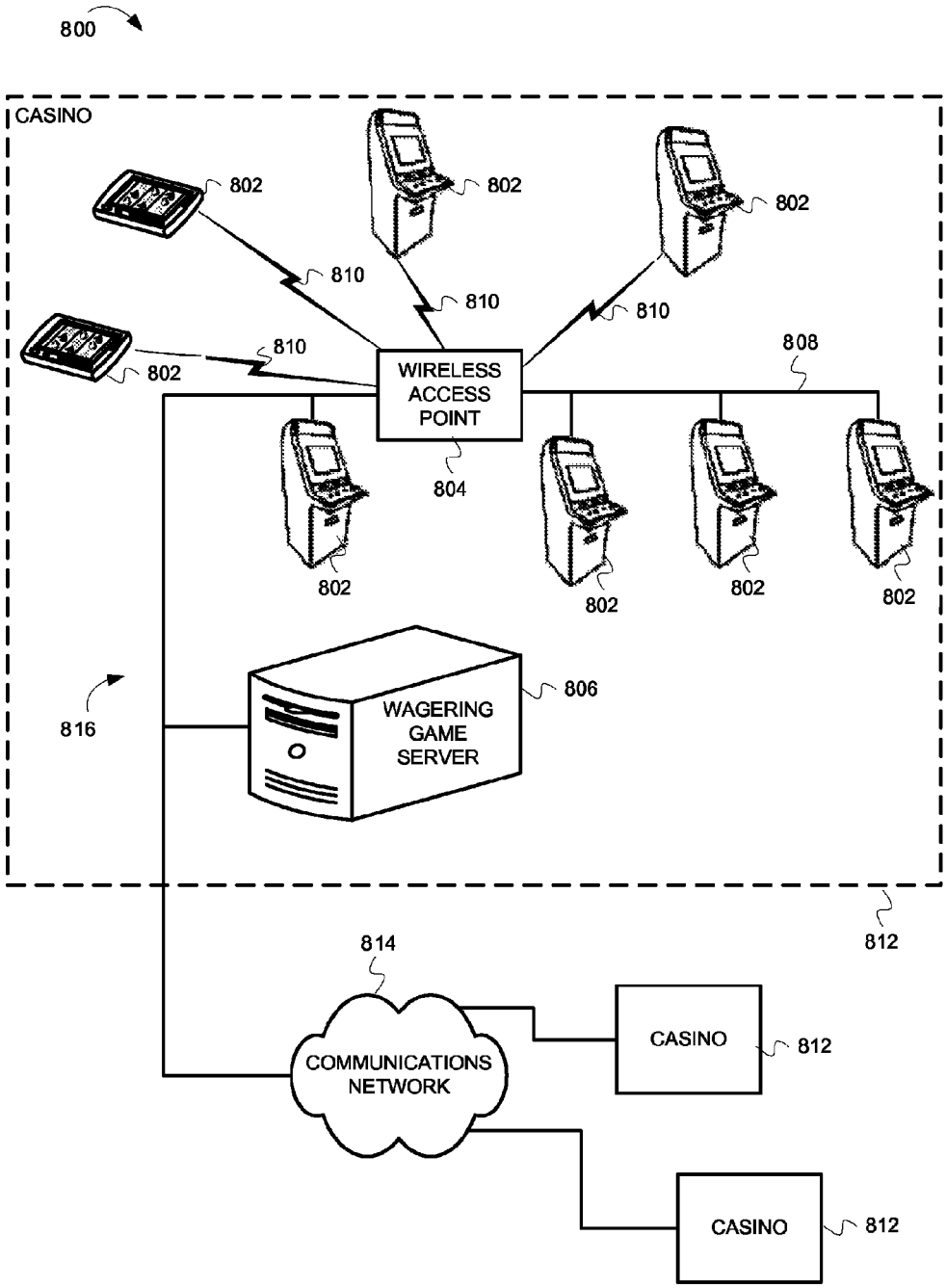
FIG. 8 is a block diagram illustrating a wagering game network 800, according to example embodiments of the invention.

FIG. 8 is a block diagram illustrating a wagering game network 800, according to example embodiments of the invention. As shown in FIG. 8, the wagering game network 800 includes a plurality of casinos 812 connected to a communications network 814.

Each casino 812 includes a local area network 816, which includes an access point 804, a wagering game server 806, and wagering game machines 802. The access point 8304 provides wireless communication links 810 and wired communication links 808. The wired and wireless communication links can employ any suitable connection technology, such as Bluetooth, 802.11, Ethernet, public switched telephone networks, SONET, etc. In some embodiments, the wagering game server 806 can serve wagering games and distribute content to devices located in other casinos 812 or at other locations on the communications network 814. The wagering game server 806 implement functionality similar to that of the floor environment server 133 of FIG. 1 and/or the floor environment server 316 of FIG. 3. The wagering game server 806 can interact with other wagering game servers (not depicted) to create environmental effects, gather state data about a physical area of wagering game establishment, gather data from a community, gather data from player accounts, gather data about online viewers and/or an online community, etc.

The wagering game machines 802 described herein can take any suitable form, such as floor standing models, handheld mobile units, bartop models, workstation-type console models, etc. Further, the wagering game machines 802 can be primarily dedicated for use in conducting wagering games, or can include non-dedicated devices, such as mobile phones, personal digital assistants, personal computers, etc. In one embodiment, the wagering game network 800 can include other network devices, such as accounting servers, wide area progressive servers, player tracking servers, and/or other devices suitable for use in connection with embodiments of the invention.

In some embodiments, wagering game machines 802 and wagering game servers 806 work together such that a wagering game machine 802 can be operated as a thin, thick, or intermediate client. For example, one or more elements of game play may be controlled by the wagering game machine 802 (client) or the wagering game server 806 (server). Game play elements can include executable game code, lookup tables, configuration files, game outcome, audio or visual representations of the game, game assets or the like. In a thin-client example, the wagering game server 806 can perform functions such as determining game outcome or managing assets, while the wagering game machine 802 can present a graphical representation of such outcome or asset modification to the user (e.g., player). In a thick-client example, the wagering game machines 802 can determine game outcomes and communicate the outcomes to the wagering game server 806 for recording or managing a player's account.

In some embodiments, either the wagering game machines 802 (client) or the wagering game server 806 can provide functionality that is not directly related to game play. For example, account transactions and account rules may be managed centrally (e.g., by the wagering game server 806) or locally (e.g., by the wagering game machine 802). Other functionality not directly related to game play may include power management, presentation of advertising, software or firmware updates, system quality or security checks, etc.

Any of the wagering game network components (e.g., the wagering game machines 802) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

determining that a wagering game event occurs at a wagering game machine;

processing wagering game event data that represent the wagering game event;

determining that the wagering game event is a near win event and determining a location associated with the near win event based, at least in part, on said processing the wagering game event data;

selecting a set of one or more environmental effect operations which, when performed, generate environmental stimuli directed at a physical area that comprises the location, wherein the set of one or more environmental effect operations are selected based, at least in part, on the wagering game event being the near win event and the location associated with the near win event;

determining a current state of the physical area, wherein said determining the current state of the physical area comprises determining at least one of population density in the physical area, noise level in the physical area, ongoing environmental effects being produced in the physical area, wagering game machine density in the physical area, floor configuration in the physical area, and pending events that affect population density in the physical area;

modifying at least a first environmental effect operation of the set of one or more environmental effect operations based, at least in part, on the current state of the physical area to generate a modified first environmental effect operation; and causing the modified first environmental effect operation to be performed.

2. The method of claim 1, wherein said causing the set of one or more environmental effect operations to be performed comprises one of transmitting the set of one or more environmental effect operations to a set of one or more environmental effect generating devices to perform corresponding ones of the set of one or more environmental effect operations, remotely invoking the set of one or more environmental effect operations on the set of one or more environmental effect generating devices, and executing instructions that implement the set of one or more environmental effect operations.

3. The method of claim 2, wherein the set of one or more environmental effect generating devices comprises one or more of a light controlling device, an audio controlling device, a receiver, a display, a vibrating chair, a scent emitter, a motion generator, and an air generating device.

4. The method of claim 1, wherein said determining that the wagering game event occurs at the wagering game machine comprises receiving the wagering game data from a wagering game process running on the wagering game machine or a portal process running on the wagering game machine.

5. The method of claim 1, wherein said determining that the wagering game event is the near win event comprises one of determining if the wagering game data indicate an event identifier that represents a near win and determining if the wagering game data indicate outcome data beyond a particular threshold that corresponds to a near win.

6. One or more non-transitory machine-readable storage media encoded with a set of instructions, which when executed by a set of one or more processors, causes the set of one or more processors to perform operations that comprise:

determining if event data generated by a wagering game instance represent a near win event;

determining an environmental effect for the near win event;

determining a modifier to apply to the environmental effect based, at least in part, on at least one of a history of wagering game events for the wagering game instance, a history of wagering game events for a player, player preferences, and current state of at least a physical area proximate to a location of the wagering game instance;

applying the modifier to the environmental effect to generate a modified environmental effect;

constructing a request message for the environmental effect for the near win event, wherein the request message indicates a physical location of the wagering game instance and the modified environmental effect; and supplying the request message to a server to request the server to produce the environmental effect directed at the physical location.

7. The one or more machine-readable storage media of claim 6, wherein the operations further comprise retrieving the event data from a logical socket in a wagering game machine.

8. One or more non-transitory machine-readable storage media encoded with a set of instructions, which when executed by a set of one or more processors, causes the set of one or more processors to perform operations that comprise:

determining that a wagering game event occurs at a wagering game machine;

processing wagering game event data that represent the wagering game event;

determining that the wagering game event is a near win event and determining a location associated with the near win event based, at least in part, on said processing the wagering game event data;

selecting a set of one or more environmental effect operations which, when performed, generate environmental stimuli directed at a physical area that comprises the location, wherein the set of one or more environmental effect operations are selected based, at least in part, on the wagering game event being the near win event and the location associated with the near win event;

determining a current state of the physical area, wherein said determining the current state of the physical area comprises determining at least one of population density in the physical area, noise level in the physical area, ongoing environmental effects being produced in the physical area, wagering game machine density in the physical area, floor configuration in the physical area, and pending events that affect population density in the physical area;

determining a modification to apply to the set of one or more environmental effect operations based, at least in part, on, on the current state of the physical area; and causing the first modified environmental effect operation to be performed.

9. The machine-readable storage media of claim 8, wherein the operations further comprise determining a community associated with a player associated with the wagering game event, wherein the operation of determining a modification to apply to the set of one or more environmental effect operations is also based on the community.

10. The machine-readable storage media of claim 9, wherein said operation of determining the community associated with the player associated with the wagering game event comprises determining a number of Internet views of the instance of the wagering game, a number of players with registered interest in the player associated with the wagering game event, a number of other players of the instance of the wagering game, and attributes of members of the community viewing the instance of the wagering game.

11. The machine-readable storage media of claim 8, wherein the operations further comprise:

analyzing player account data to determine that the player account data satisfies one or more criteria for the set of one or more environmental effect operations in response to said determining that the wagering game event occurred at the wagering game machine, wherein the player account data is associated with the wagering game machine.

12. The one or more machine-readable storage media of claim 11, wherein the operations further comprise updating environmental effect creation state data that indicates the environmental stimuli directed at the physical area, wherein the player is associated with the player account data.

13. An apparatus comprising:

means for determining that a wagering game event is a near win event and an area proximate to a wagering game machine associated with the wagering game event;

means for selecting a set of one or more environmental effects operations to be performed to create one or more environmental effects in the area proximate to the wagering game machine for the near in event;

means for collecting data about current state of an area proximate to the wagering game machine;

means for dynamically modifying the set of one or more environmental effects operations in accordance with the data about current state of the area proximate to the wagering game machine; and a network interface operable to communicate the set of one or more environmental effects operations as modified by the modifying means.

14. The apparatus of claim 13, wherein the means for dynamically modifying the set of one or more environmental effects operations is also in accordance with community data.

15. The apparatus of claim 14 further comprising means for collecting the community data.

16. The apparatus of claim 13, wherein the data about current state of the area proximate to the wagering game machine comprises one or more of population density in the area, noise level in the area, ongoing environmental effects being produced in the area, wagering game machine density in the area, floor configuration in the area, and pending events that affect population density in the area.

17. The apparatus of claim 13 further comprising means for controlling a set of one or more environmental effect generating devices to perform the set of one or more environmental effect operations.

18. The apparatus of claim 13, further comprising means for determining whether data of a player account associated with the wagering game machine satisfies one or more criteria for the set of one or more environmental effects.

* * * * *